US007331192B2

(12) United States Patent
Kummeth et al.

(10) Patent No.: US 7,331,192 B2
(45) Date of Patent: Feb. 19, 2008

(54) INSULATED CONTAINER WHICH CAN BE EVACUATED, FOR AN APPLICATION TO BE COOLED

(75) Inventors: Peter Kummeth, Herzogenaurach (DE); Peter Van Hasselt, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 359 days.

(21) Appl. No.: 11/029,394

(22) Filed: Jan. 6, 2005

(65) Prior Publication Data

US 2007/0180846 A1 Aug. 9, 2007

(30) Foreign Application Priority Data

Jan. 6, 2004 (DE) ..... 10 2004 001 805

(51) Int. Cl.
*F25D 3/08* (2006.01)

(52) U.S. Cl. ..... 62/371; 62/457.1

(58) Field of Classification Search ..... 62/371, 62/457.1, 457.6, 530
See application file for complete search history.

(56) References Cited

U.S. PATENT DOCUMENTS 4,969,556 A 11/1990 Ishimaru et al.
5,355,684 A * 10/1994 Guice ..... 62/54.2
6,209,343 B1 * 4/2001 Owen ..... 62/457.2

FOREIGN PATENT DOCUMENTS

DE 196 22 245 12/1997
JP 2000249055 9/2000

* cited by examiner

*Primary Examiner*—Melvin Jones
(74) *Attorney, Agent, or Firm*—Young & Thompson

(57) ABSTRACT

The invention relates to an insulated container (11) which can be evacuated and has an application (12) to be cooled, in which insulated container (11) a vacuum can be built up by means of a vacuum pump (22). In order to allow the vacuum pump (22) to be switched off during normal operation, a getter material (26) is arranged in the insulated container and binds gas components which penetrate into the insulated container as a result of unavoidable leakages. The invention provides for the getter material to be accommodated in maintenance areas (20), which can be disconnected by means of valves (21) from the working area (18) which contains the application (12). This allows the getter materials (26) in each maintenance area to be replaced or regenerated, while the operation of the application (12) to be cooled can be maintained owing to the partitioning of the working area (18) from the maintenance area (20).

7 Claims, 1 Drawing Sheet

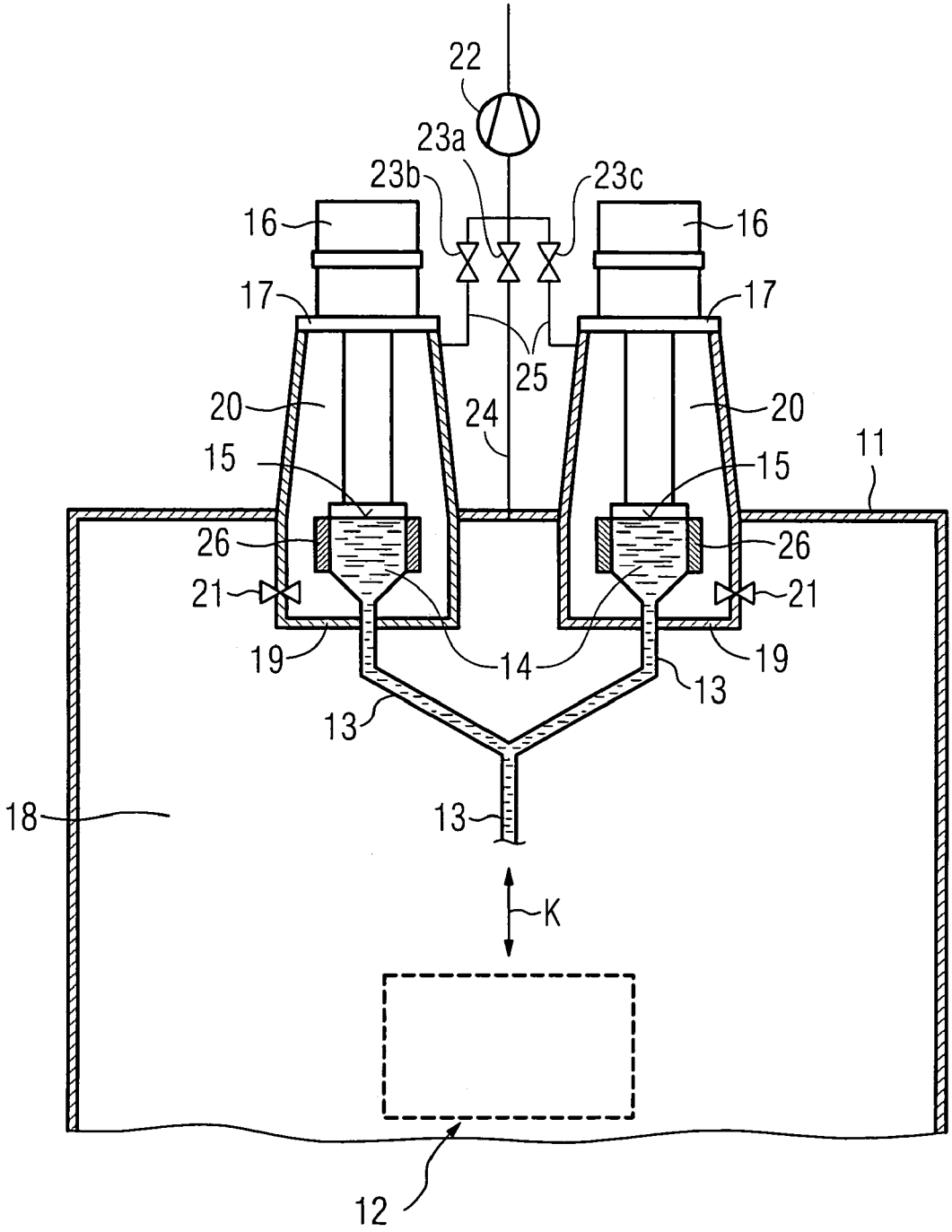
22
23a
23b
23c
16
16
17
17
25
20
24
20
15
15
11
26
26
21
21
19
14
19
13
13
13
18
K
12

INSULATED CONTAINER WHICH CAN BE EVACUATED, FOR AN APPLICATION TO BE COOLED

The invention relates to an insulated container which can be evacuated, for an application to be cooled, in which a getter material is provided in order to maintain the vacuum. An insulated container of the type described initially has been disclosed, for example, in the Abstract relating to Japanese Patent Application JP 2000-249055 A. This document discloses an insulated container in which an application to be cooled, for example a superconducting device such as a magnet coil or a transformer winding is accommodated. The insulated container can be evacuated by means of a vacuum pump, with the evacuation process improving the thermal insulation effect of the insulated container. In order to maintain the vacuum in the insulated container over a lengthy time period without having to operate the vacuum pump all the time, a getter material is also arranged in the interior of the insulated container and, within its absorption capacity, absorbs gas molecules which enter the interior of the insulated container, and would thus adversely affect the vacuum, as a result of unavoidable leakage effects.

The getter material may, for example, be activated charcoal, to which the gas molecules are physically bonded when it is in the cooled state. However, chemical getter materials also exist which, for example, can bind hydrogen by splitting double carbon bonds. As soon as the getter material is saturated, it must be replaced when chemically acting getter materials are used, and must be regenerated when physically acting getter materials are used. In order to replace the getter material, the insulated container must be opened; regeneration of the getter material is associated with its heating, so that the getter material releases the bonded condensate. Both situations thus necessitate an interruption in the use of the application to be cooled, since adequate cooling of the application to be cooled is not ensured either when the getter material is heated or when the vacuum that has been built up in the insulated container collapses owing to the replacement of the getter material.

The object of the invention is to specify an insulated container which can be evacuated for an application to be cooled and containing a getter material, in which the getter material that is used can be maintained without any interruption in the use of the application to be cooled.

According to the invention, this object is achieved in that at least one maintenance area in the insulated container is partitioned off from a working area which contains the application to be cooled, in which maintenance area the getter material is located and can be connected to the working area via a valve. The accommodation of the getter material in the maintenance area advantageously allows the getter material to be replaced or regenerated with the valve to the working area being closed, so that the vacuum can be maintained in the working area, so that there is no need to interrupt the use of the application to be cooled during the maintenance work. This is because the maintenance area can be opened for replacement of the getter material, with the vacuum collapsing only in this maintenance area, and being maintained in the working area of the insulated container. If the getter material is heated for regeneration, then the condensate that is released likewise influences only the vacuum in the maintenance area. Once the maintenance work has been completed, only the maintenance area therefore need be evacuated again, before the valve to the working area is opened again.

While the maintenance work is being carried out, the getter material is not available for maintenance of the vacuum in the working area of the insulated container. This effect can be attenuated by accommodating a number of units of the getter material in a number of maintenance areas, with the maintenance work in each case only ever being carried out in one of the maintenance areas, while the units of the getter material in the other maintenance areas remain in operation. Apart from this, the vacuum in the working area can also be maintained by means of the vacuum pump which is provided on the insulated container in any case.

One refinement of the invention provides for a holder for a cold generator to be provided in at least one maintenance area. The maintenance area can then advantageously be used not only for maintenance work relating to the getter material but also for maintenance work relating to the cold generator. By way of example the cold generator comprises a cold head which emits the cold that has been generated into the insulated container. If, by way of example, this is removed from the maintenance area for the purpose of regularly occurring maintenance work, then the getter material is also advantageously regenerated automatically owing to the lack of cooling. With a suitable design of the getter material, this means that there is no need for additional maintenance work (regeneration) on the getter material during normal operation.

It is advantageous for the cold generator to be in contact via a condenser with a line system which operates on the basis of the thermosyphon principle and is connected to the application to be cooled. The coolant located in the line system in this case transports thermal energy from the application to be cooled to the condenser, where the thermal energy is emitted to the cold generator, which is in contact with the condenser. In this case, it is advantageous for the getter material to be connected directly to the condenser. This allows the getter material to be optimally cooled by the proximity of the cold generator, thus making is possible to improve the physical effect of condensation of gas molecules contained in the vacuum. A further refinement of the invention provides for the maintenance area to have a connection for a vacuum pump. This has the advantage that the maintenance area can be evacuated separately after completion of the maintenance work, before the valve to the working area is opened again. This advantageously avoids the maintenance area having to be pumped out by means of a maintenance pump connected to the working area and passing through the working area. The connection to the working area may in this case likewise advantageously lead to the vacuum pump which is connected to the working area, thus advantageously making it possible to keep the design complexity within limits.

Further details of the invention will be described in the following text with reference to the drawing. In this case, the single FIGURE shows one exemplary embodiment of the insulated container according to the invention, with two maintenance areas, in the form of a schematic section.

An insulated container 11 as shown in the FIGURE holds a schematically indicated application 12 that is to be cooled. This application 12 is connected to a line system 13 in a manner which is not illustrated in any more detail, but in which a cooling liquid circulates.

The line system branches and ends at the top in two condensers 14, where the heat absorbed from the application 12 to be cooled is emitted via a connecting surface 15 to cold generators 16, which are in contact with this surface 15 and are in the form of cold heads. The cold heads are attached to the insulated container 11 via attachment flanges 17.

A working area 18 which contains the application 12 to be cooled and is in the insulated container is partitioned from two maintenance areas 20 by a separating wall 19 in each case. Valves 21 are located in the separating walls, may be in the form, for example, of solenoid valves, and may make a connection between the working area 18 and the maintenance areas 20 when the insulated container 11 is in normal operation. The insulated container 11 is evacuated by means of a vacuum pump 22 for normal operation. For this purpose, by way of example, the valves 21 and a pump valve 23*a* are opened, thus allowing evacuation via a pumping-out line 24. In addition to or instead of the valves 21, the pump valves 23*b*, 23*c* may be opened, so that the maintenance areas 20 can be pumped out directly via connections 25.

During normal operation of the insulated container, the pump valves 23*a*, 23*b*, 23*c* are closed, in order that the vacuum pump 22 can be switched off. In order to prevent a pressure rise occurring in the vacuum as a result of unavoidable leakage effects, units of the getter material 26 composed of activated charcoal are arranged in the maintenance areas and are directly connected to the condensers 14. Gas molecules within the vacuum are bonded to the getter materials that are cooled by the condensers until the getter material is saturated. Once the getter material 26 has been saturated, then one of the valves 21 can be closed and the relevant getter material can be regenerated by heating, that is to say the bonded gas molecules are emitted into the maintenance area 20 as a result of the heating process, and are pumped out via the vacuum pump 22 by opening the pump valves 23*b*, 23*c*. The cold generator 16 for the relevant maintenance area 20 must be switched off for this purpose, in which case the operation of the application 12 to be cooled can be maintained by cooling by means of the remaining cold generator 16. During the maintenance phase, the vacuum can additionally be maintained in the working area 18 by means of the vacuum pump 22, by opening the pump valve 23*a*.

During operation of the application 12 to be cooled, one of the cold generators 16 can in each case be removed, for example for maintenance purposes, by closing the valves 21. This is done by releasing the attachment flange 17 of the relevant cold generator 16, which closes the maintenance area 20 in the installed state, from the insulated container. When the cold generator is removed, the getter material (which is heated as a result of the lack of cooling) is automatically regenerated, thus advantageously minimizing the maintenance effort for the insulated container by synchronization of the maintenance work for the getter material 26 and the cold generator 16.

The invention claimed is:

1. An insulated container which can be evacuated, for an application (12) to be cooled, in which a getter material (26) is provided in order to maintain the vacuum, characterized in that at least one maintenance area (20) in the insulated container is partitioned off from a working area (18) which contains the application (12) to be cooled, in which maintenance area (20) the getter material (26) is located, and which maintenance area (20) can be connected to and disconnected from the working area (18) via a valve (21).

2. Insulated container as claimed in claim 1, characterized in that a holder for a cold generator (16) is provided in at least one maintenance area (20).

3. The insulated container as claimed in claim 2, characterized in that the cold generator (16) is in contact via a condenser (14) with a line system (13) which operates on the basis of the thermosyphon principle, and is connected to the application (12) to be cooled.

4. The insulated container as claimed in claim 3, characterized in that the getter material (26) is connected directly to the condenser.

5. The insulated container as claimed in claim 1, characterized in that the maintenance area (20) has a connection (25) for a vacuum pump.

6. The insulated container as claimed in claim 1, characterized in that the getter material (26) is arranged in the maintenance area (20) such that it can be replaced.

7. The insulated container as claimed in claim 1, there being two said maintenance areas (20) in the insulated container each with said getter material (26) and a said valve (21), whereby one maintenance area (20) can be isolated for replacement or repair at the same time that the other maintenance area (20) remains operative.

* * * * *